US010641257B2

(12) United States Patent
Bredbeck et al.

(10) Patent No.: US 10,641,257 B2
(45) Date of Patent: May 5, 2020

(54) RECIPROCATING-PISTON MACHINE, COMPRESSED-AIR SUPPLY INSTALLATION, COMPRESSED-AIR SUPPLY SYSTEM, AND VEHICLE HAVING A COMPRESSED-AIR SUPPLY INSTALLATION

(71) Applicant: WABCO Europe BVBA, Brussels (BE)

(72) Inventors: Klaus Bredbeck, Landesbergen (DE); Eugen Kloos, Viernheim (DE); Uwe Stabenow, Laatzen (DE)

(73) Assignee: WABCO EUROPE BVBA, Brussels (BE)

( * ) Notice: Subject to any disclaimer, the term of this patent is extended or adjusted under 35 U.S.C. 154(b) by 98 days.

(21) Appl. No.: 16/072,185

(22) PCT Filed: Jan. 19, 2017

(86) PCT No.: PCT/EP2017/000062

§ 371 (c)(1),
(2) Date: Jul. 24, 2018

(87) PCT Pub. No.: WO2017/137143

PCT Pub. Date: Aug. 17, 2017

(65) Prior Publication Data

US 2019/0032647 A1 Jan. 31, 2019

(30) Foreign Application Priority Data

Feb. 11, 2016 (DE) ..... 10 2016 001 596

(51) Int. Cl.
*F04B 27/02* (2006.01)
*F04B 27/00* (2006.01)
(Continued)

(52) U.S. Cl.
CPC ..... *F04B 27/005* (2013.01); *F04B 27/02* (2013.01); *F04B 39/0005* (2013.01);
(Continued)

(58) Field of Classification Search
CPC .... F04B 27/005; F04B 27/02; F04B 39/0022; F04B 39/0027; F16J 1/14
See application file for complete search history.

(56) References Cited

U.S. PATENT DOCUMENTS 4,729,291 A * 3/1988 Miller ..... F04B 27/02 92/138
2005/0238513 A1 10/2005 Mueller

FOREIGN PATENT DOCUMENTS

DE 3122311 A1 3/1982
DE 3340733 A1 5/1985
(Continued)

*Primary Examiner* — Michael Leslie
*Assistant Examiner* — Daniel S Collins
(74) *Attorney, Agent, or Firm* — Leydig, Voit & Mayer, Ltd.

(57) ABSTRACT

A reciprocating piston machine includes a first cylinder and a first piston assigned to the first cylinder and a second piston assigned to the first cylinder or a second cylinder. The reciprocating piston machine further includes a crankshaft having an eccentric crankshaft journal and a drive shaft coupling configured for coupling a drive shaft of a drive motor for driving the crankshaft, a first connecting rod configured to deflect the first piston and configured to be moved by the eccentric crankshaft journal, and a second connecting rod configured to deflect the second piston and configured to be moved by a bearing pin. The reciprocating piston machine additionally includes at least one of a first elastomer element arranged between the bearing pin and the first connecting rod and a second elastomer element arranged between the bearing pin and the second connecting rod.

24 Claims, 8 Drawing Sheets

(51) Int. Cl.
*F04B 39/00* (2006.01)
*F04B 53/14* (2006.01)

(52) U.S. Cl.
CPC ..... *F04B 39/0022* (2013.01); *F04B 39/0044* (2013.01); *F04B 53/145* (2013.01)

(56) References Cited

FOREIGN PATENT DOCUMENTS

| | | | |
|---|---|---|---|
| DE | 4420861 | A1 | 12/1994 |
| DE | 102004020104 | A1 | 11/2005 |
| EP | 1589224 | A1 | 10/2005 |
| WO | WO 2004029476 | A1 | 4/2004 |

* cited by examiner

RECIPROCATING-PISTON MACHINE, COMPRESSED-AIR SUPPLY INSTALLATION, COMPRESSED-AIR SUPPLY SYSTEM, AND VEHICLE HAVING A COMPRESSED-AIR SUPPLY INSTALLATION

CROSS REFERENCE TO RELATED APPLICATIONS

This application is a U.S. National Stage Application under 35 U.S.C. § 371 of International Application No. PCT/EP2017/000062 filed on Jan. 19, 2017, and claims benefit to German Patent Application No. DE 10 2016 001 596.9 filed on Feb. 11, 2016. The International Application was published in German on Aug. 17, 2017 as WO 2017/137143 A1 under PCT Article 21(2).

FIELD

The invention relates to a reciprocating-piston machine, to a compressed-air feed installation, to a compressed-air feed system, and to a vehicle having a reciprocating-piston machine, and in particular, having a piston compressor.

BACKGROUND

A compressed-air feed installation is used in vehicles of all types, in particular for feeding compressed air to an air spring installation of a passenger motor vehicle or of a utility vehicle. Air spring installations may also comprise ride-height control devices by means of which the distance between vehicle axle and vehicle body can be adjusted. An air spring installation of a pneumatic compressed-air feed system as mentioned in the introduction comprises a number of air bellows pneumatically connected to a common line (gallery), which air bellows can, with increasing filling, lift the vehicle body and, with decreasing filling, lower the vehicle body. Such a system is used for example in an off-road vehicle and in a sports utility vehicle (SUV) or in a utility or passenger transport vehicle.

To ensure long-term operation of the compressed-air feed installation, the latter has an air dryer by means of which the compressed air can be dried. The accumulation of moisture in the compressed-air feed system, which can otherwise, in the presence of relatively low temperatures, lead to valve-damaging ice crystal formation and other undesired effects in the compressed-air feed installation and in the pneumatic installation, is thus avoided. An air dryer has a drying agent, normally a granulate filling, which can be flowed through by the compressed air, such that the granulate filling—in the presence of relatively high pressure—can, by adsorption, take in moisture that is contained in the compressed air. Here, it has often proven to be expedient for the dry granulate to be accommodated in a dryer cartridge which has a dryer bed for conducting a compressed-air flow.

A compressed-air feed installation for use in a pneumatic compressed-air feed system having a pneumatic installation, for example having an air spring installation as described above, is operated with compressed air from a compressed-air supply, for example at a pressure level of 5 bar to 20 bar. The compressed air is provided to the compressed-air supply by means of an air compressor (compressor), in the present case having a reciprocating-piston machine, preferably having a two-stage or multi-stage piston compressor.

In the case of a compressed-air feed installation for a compressed-air feed system in a vehicle, the compressed-air supply which is fed by the air compressor is, on the one hand, pneumatically connected to a compressed-air connection for the feed of the pneumatic installation and, on the other hand, pneumatically connected to a ventilation connection. By means of a ventilation valve arrangement, the compressed-air feed installation and/or the pneumatic installation can be ventilated by discharging of air in the direction of the ventilation connection.

The reciprocating-piston machine in the air compressor (compressor) of the compressed-air supply is generally driven by means of a drive motor, the drive power of which is transmitted via a crankshaft and via one or more connecting rods to one or more pistons of the preferably two-stage or multi-stage piston compressor; in each case a piston runs in a sealed manner in a cylinder during operation. The drive of the reciprocating-piston machine in the air compressor (compressor) of the compressed-air supply may also be realized for example by means of a belt drive.

In this way, ambient air that is drawn in, or intake air supplied from some other compressed-air source, is compressed. For this purpose, so-called twin piston compressors have basically proven expedient, that is to say two-stage piston compressors whose two pistons are driven by means of two connecting rods that are respectively assigned to said pistons, which connecting rods are, for example, in turn aligned exactly along a cylinder axis which is preferably aligned exactly parallel to and centrally symmetrical with respect to cylinder lining surfaces in the cylinder displacement chamber for the pistons.

Depending on the demanded dynamics and pressure loading, a two-stage or multi-stage compressor of said type or of some other type may, during operation, generate increasing operating noises which—as has been found—may be caused significantly by transmission of body-borne sound through the crank drive inter alia into the drive motor of the compressor or into the housing thereof. It is desirable to realize improved acoustics and a nevertheless reliable connecting-rod drive in a compressor in the form of the stated reciprocating-piston machine. This should in particular also be sufficient for a particularly low noise level in the passenger motor vehicle sector.

For example, DE 10 2004 020 104 discloses a twin compressor with symmetrically mounted double pistons for a compressor, having an elongate piston support which has a piston on each end, and having a connecting rod which runs approximately parallel to the piston support and which, by means of a bearing, is mounted rotatably on a pin of the piston carrier and which, at a distance therefrom, is mounted by means of a connecting-rod bearing on an eccentric of a drive device. The piston carrier comprises, in a central region extending between the two pistons, an intermediate space which is dimensioned for accommodating the connecting rod in freely movable fashion and in which the connecting rod is received in freely movable fashion.

SUMMARY

In an embodiment, the present invention provides a reciprocating-piston machine. The reciprocating piston machine includes a first cylinder and a first piston assigned to the first cylinder and a second piston assigned to the first cylinder or a second cylinder, wherein the first piston and the second piston are configured, during operation, to be deflected in a respective cylinder displacement chamber. The reciprocating piston machine further includes a crankshaft configured, during operation, to be driven, the crankshaft having an eccentric crankshaft journal and a drive shaft coupling configured for coupling a drive shaft of a drive motor for driving the crankshaft, a first connecting rod configured to deflect the first piston and configured to be moved by the eccentric crankshaft journal, and a second connecting rod configured to deflect the second piston and configured to be moved by a bearing pin about which the first connecting rod and the second connecting rod are rotationally movable. The reciprocating piston machine additionally includes at least one of: a first elastomer element arranged between the bearing pin and the first connecting rod, the first elastomer element mounting the bearing pin and the first connecting rod elastically with respect to one another, and a second elastomer element arranged between the bearing pin and the second connecting rod, the second elastomer element mounting the bearing pin and the second connecting rod elastically with respect to one another.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
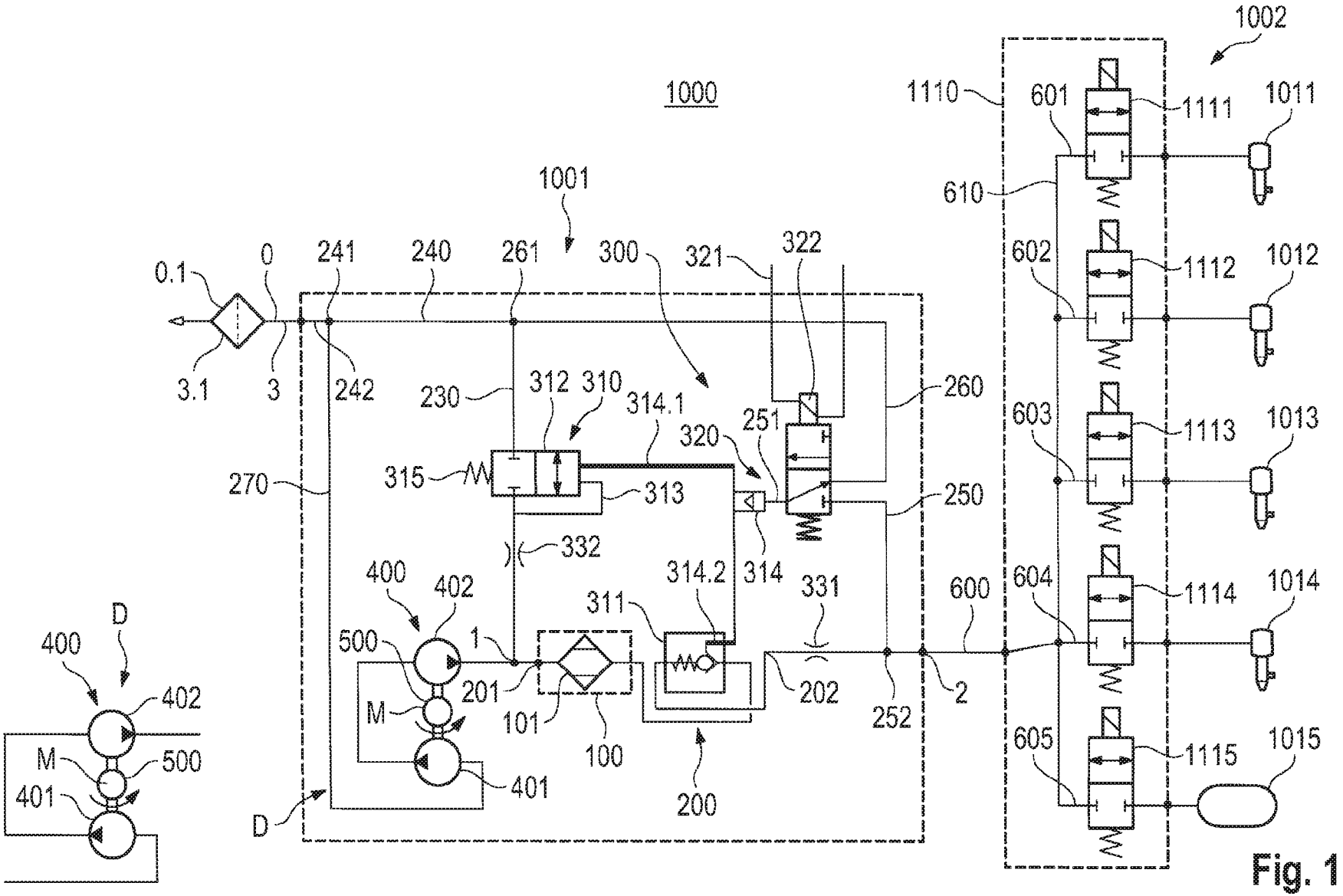
FIG. 1 shows a pneumatic circuit for an embodiment of a compressed-air feed installation with connected pneumatic installation in the form of an air spring installation for a vehicle, wherein a two-stage piston compressor shown in the detail D, in the context of an air compressor, feeds compressed air to the air spring installation via an air dryer arrangement and a valve arrangement in the form of an unblockable check valve, which is switchable by means of a controllable solenoid valve.

The present invention recognizes that foregoing prior art solutions run the risk of causing relatively high levels of noise generation and transmission of body-borne sound through the crank drive into the compressor drive motor and thus also to the outside. This is caused by a change in force direction in the joint, brought about by the compression and suction (underpressure) of the first stage. Significant acoustic relevance arises additionally from the defined initial clearances, depending on production processes and the tolerances thereof, and the increase in these over the service life, caused by run-in characteristics and wear.

Embodiments the invention provide reciprocating-piston machines, in particular a two-stage or multi-stage piston compressors, preferably twin compressors, and compressed-air feed installations for operating a pneumatic installation with a compressed-air flow, by way of which improved acoustics and a nevertheless reliable crank drive in a piston compressor can be realized. Embodiments of the present invention can reduce noise levels to those suitable for noise level requirements in the passenger motor vehicle sector. In particular, in the context of acoustic improvements, embodiments of the present invention can reduce body-borne sound emissions of a connecting-rod drive into adjoining, radiating components, such as an electric motor, a crank drive, or similar components of an air compressor (compressor). Furthermore, embodiments of the invention can provide a compressed-air feed installation that is relatively compact. Additional embodiments of the invention provide corresponding compressed-air feed systems and vehicles having such a compressed-air feed system, in particular for an air spring installation.

According to embodiments of the invention, reciprocating-piston machines, in particular having a two-stage or multi-stage piston compressor and preferably a twin compressor, are provided having at least one cylinder and at least one first piston assigned to the cylinder and one second piston assigned to the or a cylinder, wherein, during operation, the pistons are deflected in a respective cylinder displacement chamber of the at least one cylinder, a crankshaft which, during operation, can be driven and which has an eccentric crankshaft journal and a drive shaft coupling which is designed for the coupling of a drive shaft of a drive motor for driving the crankshaft, a first connecting rod designed for deflecting the first piston, a second connecting rod designed for deflecting the second piston, and a bearing pin about which the first and second connecting rod are rotationally movable, wherein the first connecting rod (second compressor stage) is movable by means of the eccentric crankshaft journal, and the second connecting rod (first compressor stage) is movable by means of the bearing pin.

It is provided, according to embodiments of the invention that, between the bearing pin, on the one hand, and the first connecting rod, on the other, there is arranged at least one, in particular a first, elastomer element mounting the bearing pin, on the one hand, and the first connecting rod, on the other hand, elastically with respect to one another, and/or between the bearing pin, on the one hand, and the second connecting rod, on the other hand, there is arranged the at least one or at least one, in particular a second, elastomer element mounting the bearing pin, on the one hand, and the second connecting rod, on the other hand, elastically with respect to one another.

In a first variant ("and"), the elastomer element can extend along the bearing pin so that it is located between the first connecting rod and the bearing pin, and between the bearing pin and the second connecting rod. It is also possible, in a modification of the first variant ("and"), for multiple elastomer elements, for example two elastomer elements, to be provided, so that in each case one of the elastomer elements is arranged between the first connecting rod and the bearing pin and another of the elastomer elements is arranged between the second connecting rod and the bearing pin.

In a second variant ("or"), the elastomer element can extend along the bearing pin so that it is located only between the first connecting rod and the bearing pin. It is also possible, in a modification of the second variant ("or"), for multiple elastomer elements, for example two elastomer elements, to be provided, so that in each case one of the elastomer elements is arranged between the first connecting rod and the bearing pin and another of the elastomer elements is also arranged between the first connecting rod and the bearing pin.

In a third variant ("or"), the elastomer element can extend along the bearing pin so that it is located only between the second connecting rod and the bearing pin. It is also possible, in a modification of the second variant ("or"), for multiple elastomer elements, for example two elastomer elements, to be provided, so that in each case one of the elastomer elements is arranged between the second connecting rod and the bearing pin and another of the elastomer elements is also arranged between the second connecting rod and the bearing pin.

According to embodiments of the invention, compressed-air feed installations are achieved by way of a compressed-air feed installation for operating a pneumatic installation, in particular an air spring installation of a vehicle, preferably of a passenger motor vehicle, with a compressed-air flow, having an air dryer arrangement in a pneumatic main line which pneumatically connects a compressed-air supply from an air compressor and a compressed-air connection to the pneumatic installation, and a valve arrangement which is pneumatically connected to the pneumatic main line and which serves for controlling the compressed-air flow, and an air dryer in the pneumatic main line, wherein an air compressor with a reciprocating-piston machine, in particular a two-stage or multi-stage piston compressor, preferably twin compressor, is connected to the compressed-air supply.

According to embodiments of the invention, compressed-air feed systems are provided having a pneumatic installation and having a compressed-air feed installation that serves for operating a pneumatic installation with a compressed-air flow, in particular an air spring installation of a vehicle, preferably of a passenger motor vehicle, wherein the pneumatic main line pneumatically connects a compressed-air supply from an air compressor with a reciprocating-piston machine, in particular a two-stage or multi-stage piston compressor, preferably twin compressor, and a compressed-air connection to the pneumatic installation.

According to embodiments of the invention, vehicles, in particular passenger motor vehicles, are equipped with a pneumatic installation, in particular an air spring installation, and with a compressed-air feed installation for operating the pneumatic installation with a compressed-air flow.

A cylinder axis is aligned substantially symmetrically with respect to cylinder lining surfaces for the pistons in the cylinder displacement chambers of the at least one cylinder. A cylinder axis with cylinder displacement chambers aligned therewith is to be understood in particular to mean that the cylinder lining surfaces at the cylinder displacement chambers of a cylinder for the piston are exactly parallel and symmetrical with respect to the cylinder axis.

The eccentric crankshaft journal—in particular also the drive shaft coupling—is preferably aligned parallel to a shaft axis aligned perpendicular to the cylinder axis; that is to say, the crankshaft journal and/or a connecting-rod bearing surrounding the latter is perpendicular to the cylinder axis.

Depending on the demanded dynamics and pressure loading in the case of an air compressor, a two-stage or multi-stage compressor, in particular a two-stage twin compressor or some other reciprocating-piston machine, during operation, increasingly generates operating noises which—as has been found—may be caused in particular by transmission of body-borne sound through the crank drive into the compressor drive motor. A high, tolerance-dependent dispersion of noise generation occurs in particular upon changes in force, i.e. upon transitioning from suction to compression or expansion to suction. It is evident, as identified by the invention, that the operating noises are caused in part by connecting-rod bearing clearances that are required from a design aspect in the prior art. Plain bearings become worn over time, such that relatively long use of the plain bearings results in a relatively great increase in connecting-rod bearing clearance, which leads to an increase in noise. Plastics plain bearings exhibit good damping characteristics, are sensitive to wear at high temperatures and exhibit pronounced run-in characteristics, which leads to an increase in connecting-rod bearing clearance. By contrast, rolling bearings basically exhibit poor damping characteristics, because in this case, there is typically steel-on-steel contact.

Embodiments of the invention provide improved acoustics in a compressor by providing at least one elastomer element for the mounting of at least one of the connecting rods with respect to the bearing pin, i.e. of the first and/or of the second connecting rod with respect to the bearing pin; even with low noise generation that is in particular acceptable for the passenger motor vehicle sector. Furthermore, the concept of the present invention is likewise preferable for a utility vehicle or passenger transport vehicle, in particular if, in these, the compressed-air feed installation is designed for relatively high pressure amplitudes.

The present invention recognizes that previous solutions—presented in a simplified manner—provide ball bearings or plain bearings for the bearing arrangement between the first connecting rod and the bearing pin and between the second connecting rod and the bearing pin. The present invention further recognizes that deflection of the first and second connecting rods with respect to one another, or of the longitudinal axes running along the connecting rods, is small, i.e. less than 20°, in particular less than 14°. Embodiments of the invention provide for the replacement of the connecting-rod bearings, in particular rolling bearings or plain bearings, by elastomer elements. Elastomer elements can serve as clearance-free connecting elements and have good damping characteristics. In this manner, the noise generation can be advantageously significantly suppressed. Mounting using elastomer elements is possible by virtue of the small deflection.

Embodiments of the present invention permit, in particular, an improvement of the acoustic characteristics, in particular of a two-stage twin compressor, because the elastomer element is freely parameterizable with regard to its design criteria. For example, the selection of the material, that is to say the hardness, and the geometry of the elastomer element, that is to say the diameter, the width, the wall thickness and/or similar parameters, is freely parameterizable. This can lead, inter alia, to a reduction in the noise generation, in particular of the initial level, of the level distribution and of the level increase of the service life. The free parameterizability makes it possible for the elastomer element to always be adapted to the prevailing operating conditions. By virtue of the invention, the compressor acoustics are independent of the tolerance since the mounting using the elastomer element is independent of bearing clearance. Furthermore, it is possible to reduce the number of components since it is possible to dispense with plain bearings or rolling bearings and their dampening elements. This simplifies, inter alia, also the assembly. Moreover, there is no relative movement of adjacent surfaces, i.e. of sliding surfaces or rolling surfaces, relative to a connecting rod inner side surface or a bearing pin surface. In particular, the elastomer element or multiple elastomer elements can also replace conventional plain bearings or rolling bearings since these are compatible with the conventional connecting rod designs, or the conventional connecting rod construction.

Embodiments of the invention also make it possible, in particular, to establish a clearance-free connection between two connecting rods. It is also possible to improve the force transfer between the compressor and the crankshaft by virtue of the good dampening properties of the elastomer element. The elastomer element permits a relative movement between the two connecting rods of at least approximately 14° or +/−7°. Also possible are a force transfer of up to 1500 N and a maximum speed of approximately 0.20 m/s. The reciprocating-piston machine can be formed such that it is essentially maintenance-free and has for example a fatigue strength for approximately 1000 operating hours. For example, no initial and/or subsequent lubrication is necessary, as is the case for plain bearings and/or rolling bearings. Also there is no damaging abrasion as is the case for plain bearings and/or rolling bearings. Furthermore, cost reduction by reduction in the number of components is possible since only one elastomer element is required, instead of a rolling bearing and/or plain bearing with additional decoupling and/or dampening elements.

The reciprocating-piston machine described here in the context of a compressed-air feed installation for use in a pneumatic compressed-air feed system, in particular the piston compressor, may however basically also be used in other fields of application, in particular where—as in the case of the stated compressed-air feed installations—it is sought to realize relatively high pressure amplitudes in a flexible and dynamic manner. In particular, the reciprocating-piston machine may be used in a compressor for a passenger motor vehicle chassis control arrangement. Furthermore, the reciprocating-piston machine, in particular the piston compressor, may be used in a multi-stage compressor with at least two compressor stages which operate in accordance with the drag piston principle.

A connecting rod may be of rigid form without joint bearing, or else may be of jointed form, in particular with a joint bearing. A piston may be retained or held on the connecting rod or formed integrally on the connecting rod. The piston is preferably integrally formed on the connecting rod, fixedly connected to said connecting rod or held on said connecting rod by means of a piston holder.

In a particularly preferred refinement, the at least one connecting rod is mounted directly or indirectly on the crankshaft journal by means of at least one connecting-rod bearing. To that end, the at least one connecting rod can be mounted with a single connecting-rod bearing directly or indirectly, or with a connecting-rod bearing directly and the elastomer element indirectly, on the crankshaft journal. To that end, the first connecting rod (second compressor stage) is preferably mounted with a single connecting-rod bearing directly or indirectly, or with a connecting-rod bearing directly and the elastomer element indirectly on the crankshaft journal with the second connecting rod (first compressor stage). Direct mounting is to be understood as meaning that the connecting rod is moved directly by the crankshaft journal via the connecting-rod bearing. An indirect mounting is to be understood to mean that the connecting rod is moved by the crankshaft journal via a further component (for example preferably the first connecting rod or the first connecting rod and the bearing pin), that is to say indirectly, but is not directly mounted on said crankshaft journal.

In a particularly preferred refinement, the first connecting rod may be movable directly by means of the eccentric crankshaft journal, and the second connecting rod may be movable indirectly by means of the eccentric crankshaft journal, in particular directly by means of the first connecting rod. Preferably, in this refinement, the second connecting rod (as follower connecting rod) is movable by the first connecting rod (as drive connecting rod), wherein the first connecting rod is moved directly by the crankshaft journal. An abovementioned refinement has proven to be expedient in particular for realizing a two-stage piston compressor, which can also be referred to as twin compressor, specifically with two oppositely situated pistons along a cylinder axis.

The at least one elastomer element is preferably a rubber element or introduced as a rubber coating between the bearing pin and connecting rod. In particular, the rubber coating may be introduced to, for example vulcanized onto, injection-molded onto or similar, the pin surface and/or the connecting-rod inner surface. The elastomer element may be an applied layer, in particular an injection-molded or vulcanized-on layer. Preferably, the applied layer is applied to a bearing pin surface, to a connecting-rod inner surface of the first connecting rod and/or to a connecting-rod inner surface of the second connecting rod. The elastomer element, in particular in the form of an applied layer, serves for mounting rotational movements of the connecting rods about the bearing pin and for generating a resilient action. In particular, the bearing connection between the bearing pin and the first or, respectively, second connecting rod is realized by the elastomer element or the elastomer layer, so that a further bearing element, such as a ball bearing, a rolling bearing, a plain bearing, a plain bearing shell or the like is omitted. The elastomer element has a material-dependent hardness. Use is preferably made of a material, such as for example rubber for the elastomer element, which exhibits good damping characteristics in order to permit a noise reduction. In particular, a rubber mixture may be used in order to adapt the characteristics of the rubber as material for the elastomer element. Furthermore, the characteristics of the elastomer element can be set by means of the geometry of the elastomer element. For example, a shape, in particular the width, height, length, diameter and wall thickness, may be adapted in accordance with the respective operating conditions.

In one refinement, the elastomer element may be a separate part. The elastomer element is preferably placed between the bearing pin and connecting rod or clamped exclusively between the bearing pin and connecting rod. The elastomer element may extend along the longitudinal axis of the bearing pin, such that the elastomer element is arranged between the bearing pin and the first connecting rod and the second connecting rod. It is alternatively also possible for multiple elastomer elements to be provided, which are in each case arranged between the bearing pin and the first connecting rod or between the bearing pin and the second connecting rod. It is thus also possible, for example, for two elastomer elements to be arranged between the bearing pin and the first connecting rod and/or for two elastomer elements to be arranged between the bearing pin and the second connecting rod. It is however also possible for only one elastomer element to be arranged between the first connecting rod and the bearing pin and/or for only one elastomer element to be arranged between the second connecting rod and the bearing pin. The elastomer element preferably serves for enabling rotational movements of the connecting rods about the bearing pin and for generating a dampening action. In particular, the bearing connection between the bearing pin and the first or, respectively, second connecting rod is realized by the elastomer element, so that a further bearing element, such as a ball bearing, a rolling bearing, a plain bearing or the like is omitted. Thus, the elastomer element alone serves for absorbing and/or equalizing the rotational movement and can, in so doing, generate a dampening action.

In a preferred refinement, the elastomer element is of ring-shaped, bushing-shaped or sleeve-shaped form. The shape of the elastomer element may also be adapted to the shapes of the components which adjoin the elastomer element and/or which are mounted by the elastomer element. The elastomer element may also be of hollow cylindrical form. The wall thickness of the elastomer element is preferably constant. In one refinement, the wall thickness changes along a longitudinal axis of the elastomer element; in particular, the wall thickness increases or decreases. The wall thickness and the change in the wall thickness are preferably adapted to the operating conditions and in particular to the components that are in contact with the elastomer element, such as for example the connecting rod and the bearing pin.

In a further refinement, the elastomer element is plate-shaped, in particular a stud or ring-segment-shaped. The elastomer element may have one, two or more ring segments, for example elastomer ring segments, in particular rubber ring segments. The ring segments are preferably arranged opposite one another and in particular around the bearing pin. The parameters of the ring segments may also be adapted in accordance with the operating conditions; in particular, the geometry thereof and the material used may be selected in accordance with the operating conditions. The use of ring segments permits a reduction in the restoring torque. Moreover, the reduction from an elastomer element surrounding the circumference to elastomer ring segments leads to a reduction in material consumption and to smaller elements. In this way, a transmission of load is necessary only into two ring segments. Plate-shaped elastomer elements, i.e. elastomer plates, can be arranged around the bearing pin, for example 180 elastomer plates can be arranged around the bearing pin so that each elastomer plate covers 2° of the bearing pin surface.

In a preferred refinement, the elastomer element is connected to or in contact with a metal support. The metal support may for example be a metal bushing, a metal sleeve, a metal ring or a plurality of metal plates. The elastomer element may for example be clamped into, adhesively bonded onto, vulcanized onto, or injection-molded into the metal support. In this case, the metal support preferably encloses the elastomer element. The elastomer element may also for example be clamped, adhesively bonded, vulcanized or injection-molded around the metal support. In this case, the elastomer element preferably encloses the metal support. It is also possible for an elastomer element to be arranged between two metal supports, for example in a sandwich-like manner. It is also possible for a metal support to be arranged between two elastomer elements, for example in a sandwich-like manner. In this case, the elastomer elements may be injection-molded onto the metal support and injection-molded into said metal support, or else may be separate parts, for example elastomer rings, which can be placed into and/or placed around said metal support.

In a further refinement, the elastomer element has at least two elastomer rings. The elastomer rings are preferably arranged parallel and with a spacing to one another around the bearing pin. The elastomer rings may both be arranged between the first connecting rod and the bearing pin or between the second connecting rod and the bearing pin. It is furthermore also possible for a respective one of the elastomer rings to be arranged between the first connecting rod and the bearing pin and between the second connecting rod and the bearing pin. It is also possible, for example, for three elastomer rings to be arranged. In this case, for example, two elastomer rings can be arranged between the second connecting rod and the bearing pin and one elastomer ring can be arranged between the first connecting rod and the bearing pin. It is also possible for elastomer plates or segmented elastomer rings to be arranged between the connecting rods and the bearing pin.

In a further refinement, the elastomer element has at least one elastomer plate arranged only at one side, in particular at a bearing pin top side. Alternatively or in addition, the elastomer element may have at least two mutually oppositely situated elastomer plates arranged at the bearing pin top side and at a bearing pin bottom side. The two mutually oppositely situated elastomer plates serve for mounting the bearing pins and at least one of the connecting rods.

In a preferred refinement, the at least one elastomer element is arranged between an inner and an outer metal support. It is preferable for the inner metal support to be connected to the bearing pin and for the outer metal support to be connected to at least one of the connecting rods. Here, the term connected includes the meanings clamped into, clamped, clamped onto, pressed, injection-molded onto, injection-molded into, vulcanized onto, affixed, inserted, attached and introduced. The connection may for example be such that an elastomer element for example in the form of an elastomer ring is clamped between the inner and the outer metal support. It is particularly preferable for the elastomer element to be fixedly and directly connected to the inner and to the outer metal support, for example by virtue of the elastomer element being introduced as a coating or a layer to an outer surface of the inner metal support and to an inner surface of the outer metal support, for example by being injection-molded in, vulcanized on or introduced using one or more other methods. Furthermore, the inner metal support may be fixedly and directly connected to the bearing pin and the outer metal support may be fixedly and directly connected to at least one of the connecting rods, for example by virtue of the metal supports being clamped under stress. It is also possible for multiple metal supports to be arranged one inside the other, or for example for a metal support to be arranged between two elastomer elements. An arrangement of multiple alternating layers of metal supports and elastomer elements is also possible. In particular, the elastomer elements may have different material characteristics in order to thereby adapt the mounting of the connecting rod to the operating conditions.

In a further preferred refinement, the at least one elastomer element is arranged between an inner metal support and at least one of the connecting rods. The inner metal support is preferably connected to the bearing pin, and the elastomer element is preferably connected to at least one of the connecting rods. The connection may for example be such that the elastomer element, for example in the form of an elastomer ring, is clamped between the inner metal support and at least one of the connecting rods. It is particular preferable for the elastomer element to be firmly and directly connected to the inner metal support and to at least one of the connecting rods, for example by virtue of the elastomer element being introduced as a coating or layer to an outer surface of the inner metal support and to a connecting-rod surface of at least one of the connecting rods, for example by being injection-molded in, vulcanized on or introduced using one or more other methods.

Furthermore, in a further preferred refinement, the at least one elastomer element is arranged between the bearing pin and an outer metal support. The elastomer element is preferably connected to the bearing pin, and the outer metal support is preferably connected to at least one of the connecting rods. The connection may for example be such that the elastomer element, for example in the form of an elastomer ring, is clamped between the bearing pin and the outer metal support. The elastomer element is particularly preferably firmly and directly connected to the bearing pin and to the outer metal support, for example by virtue of the elastomer element being introduced as a coating or a layer to a bearing pin surface of the bearing pin and to an inner surface of the outer metal support, for example by being injection-molded in, vulcanized on or introduced using one or more other methods.

In a further refinement, the elastomer element is designed as a rubber element and is injection-molded between two steel sleeves. Said component is preferably pressed into a connecting rod and/or pressed onto the bearing pin. A further refinement provides for the elastomer element to be designed as a rubber element and injection-molded onto a steel bushing. Said component is preferably pressed and/or adhesively bonded into a connecting rod. In a yet further refinement, the elastomer element may be designed as a rubber element and injection-molded onto a steel bushing and/or injection-molded into a connecting rod. The elastomer element may, as a rubber element, also be installed as a solid rubber part, for example by being pressed in and/or adhesively bonded. In a further refinement, the elastomer element may be designed as a rubber element which is arranged in at least two parts on the circumference of the connecting rod.

In a further preferred refinement, the at least one elastomer element has at least two mutually separate ring segments. Of the at least two separate ring segments, it is preferable for at least one first ring segment to be arranged on a bearing pin top side between bearing pin and connecting rod and for at least one second ring segment to be arranged on a bearing pin bottom side between bearing pin and connecting rod. The mutually separate ring segments of the elastomer element may for example enclose at most one quarter of the circumference on the bearing pin top side and at most one quarter of the circumference on the bearing pin bottom side, such that at least half of the circumference of the bearing pin is free from the elastomer element.

In a preferred refinement, a maximum deflection angle of the deflection of the connecting rods between respective longitudinal axes of the connecting rods amounts to at most 14°, for example at most 10° and preferably approximately 7°.

In a further refinement, it has proven to be advantageous for the first connecting rod to be mounted by means of a connecting-rod bearing directly on the crankshaft journal and for the first piston to be held on the first connecting rod by means of a piston holder. In addition or alternatively, the second piston can be integrally formed on the second connecting rod. In this case of the refinement, a follower connecting rod with an integrally formed piston, and a drive connecting rod with a piston held thereon, are preferably realized. It is basically possible, independently of this refinement, for a piston integrally formed in the connecting rod or a piston held in the connecting rod to be realized in accordance with requirements. For a follower connecting rod formed with the (low-pressure) compressor stage of a twin compressor, in particular, an integrally formed piston has proven to be expedient. For a (high-pressure) compressor stage, discussed further below, of a twin compressor, in particular, a drive connecting rod with a piston held thereon has proven to be expedient.

In a preferred design implementation, the connecting-rod bearing may be realized as a ring ball bearing, which is preferably in the form of a ring ball bearing on the crankshaft journal, that is to say is formed directly on the crankshaft journal. The connecting-rod bearing may also be a ring ball bearing and/or a joint bearing.

As already mentioned further above, a reciprocating-piston machine as a piston compressor with a two-stage compressor with a first and a second compressor stage has proven to be particularly expedient for the provision of compressed air for a compressed-air feed installation. In particular, the two-stage compressor may be in the form of a twin compressor. The piston compressor may also be in the form of a twin-cylinder or multi-cylinder compressor.

It is in particular provided that the first connecting rod of the second, in particular high-pressure, compressor stage is formed, wherein the first connecting rod is mounted directly on the crankshaft journal by means of a connecting-rod bearing.

In addition or alternatively, it has been found to be advantageous that the second connecting rod of the first, in particular low-pressure, compressor stage is formed.

One aspect of the invention relates to the use of the reciprocating-piston machine, in particular of the piston compressor, in a compressor or air compressor for a passenger motor vehicle chassis control arrangement.

FIG. 1 shows, in the detail D, an air compressor having a reciprocating-piston machine in the form of a two-stage piston compressor 400 with a first compressor stage 401 and a second compressor stage 402, which is driven by means of a motor 500 as drive motor M.

A piston compressor 400 of said type is preferably used for pneumatic compressed-air feed systems 1000, such as is shown in FIG. 1.

FIG. 1 shows a pneumatic circuit diagram of a pneumatic compressed-air feed system 1000 with a compressed-air feed installation 1001 with an air dryer arrangement 100 and with a pneumatic installation 1002 in the form of an air spring installation. The compressed-air feed installation 1001 serves for operating the pneumatic installation 1002. The compressed-air feed installation 1001 has, for this purpose, an abovementioned compressed-air supply 1 and a compressed-air connection 2 to the pneumatic installation 1002.

In the present case, the compressed-air supply 1 is formed with an air supply 0, with an air filter 0.1 positioned upstream of the air supply 0, and with an air compressor which is positioned downstream of the air supply 0 via the air supply line 270 and which is driven by means of the motor 500. Here, the air compressor is, in the example of a reciprocating-piston machine, formed in the manner of a double air compressor, specifically a two-stage piston compressor 400 with a first compressor stage 401 and with a second compressor stage 402 and with a connection (not designated in any more detail) of the compressed-air supply 1.

The connection of the compressed-air supply 1 connects, in the pneumatic main line 200, at the first part 201 of the pneumatic main line, to the connection of the drying container 101 of the air dryer arrangement 100. The air dryer of the air dryer arrangement 100 is furthermore pneumatically connected by means of the second part 202 of the pneumatic main line, for the guidance of a compressed-air flow DL, to the pneumatic installation 1002.

In the main view shown in FIG. 1, it is provided that a branch line 230 branches off from the pneumatic main line 200 at the compressed-air supply 1 and connects to a ventilation line 240 for the ventilation to a ventilation filter 3.1 positioned downstream of the ventilation connection 3; the ventilation arrangement is connected by means of a further branch connection 241 and a connection section 242 to the ventilation line 240, and also via the branch connection 261 to a further ventilation line 260.

The pneumatic main line 200 thus pneumatically connects the compressed-air supply 1 and the compressed-air connection 2, wherein, in the pneumatic main line 200, there are arranged the air dryer arrangement 100 and, further in the direction of the compressed-air connection 2, an unblockable check valve 311 and a first throttle 331.

The pneumatically unblockable check valve 311 is, in the present case, a part of the directional valve arrangement 310 which has not only the unblockable check valve 311 but also a controllable ventilation valve 312 connected in series with a second throttle 332 in the ventilation line 230. The pneumatically unblockable check valve 311 is in the present case likewise arranged so as to be connected in series with the first throttle 331 in the pneumatic main line 200, wherein the pneumatic main line 200 is the only pneumatic line of the first pneumatic connection that continues with a further pneumatic line 600 to the pneumatic installation 1002. The series arrangement of first throttle 331 and pneumatically unblockable check valve 311 is thus arranged in the pneumatic main line 200 between the air dryer arrangement 100 and the compressed-air connection 2 to the pneumatic installation 1002.

Furthermore, the compressed-air feed installation 1001 has a second pneumatic connection, specifically the abovementioned ventilation line 230, which is pneumatically connected to the pneumatic main line 200 and to the ventilation connection 3 and to the further filter 3.1 and/or silencer. In the present case, the nominal width of the second throttle 332 is greater than the nominal width of the first throttle 331.

The ventilation valve 312 arranged in the second pneumatic connection is in the present case in the form of a 2/2 valve, which is separate from the pneumatically unblockable check valve 311, in the ventilation line 230.

The controllable ventilation valve 312 is thus, as an indirectly switched relay valve, part of a valve arrangement 300 with a control valve 320 in the form of a 3/2 directional solenoid valve. The control valve 320 can, by means of an electrical control signal, in the form of a voltage and/or current signal, which can be transmitted via an electrical control line 321, be electrically actuated at the coil 322 of the control valve 320. Upon this electrical actuation, the control valve 320 can be transferred from the electrically deenergized position shown in FIG. 1, in which it shuts off the pneumatic control line 250, into a pneumatically opened position, in which pressure discharged from the pneumatic main line 200 via the pneumatic control line 250 is transmitted onward for the pneumatic control of the controllable ventilation valve 312 as relay valve.

The controllable ventilation valve 312 is in the present case additionally equipped with a pressure-limiting means 313. The pressure-limiting means 313 picks off, via a pneumatic control line upstream of the ventilation valve 312, specifically between the second throttle 332 and ventilation valve 312, a pressure which, in the event of a threshold pressure being exceeded, lifts the piston 314 of the ventilation valve 312 off the valve seat counter to the force of an adjustable spring 315, that is to say which moves the controllable ventilation valve 312 into the open position even in the absence of actuation by means of the control valve 320. This prevents an undesirably excessively high pressure from being generated in the pneumatic system 1000.

In the present closed state, the control valve 320 shuts off the control line 250, and is pneumatically connected via a further ventilation line 260 to the ventilation line 240 for ventilation via the ventilation connection 3. In other words, in the closed position of the control valve 320 shown in FIG. 1, a line section 251 of the control line 250 that is situated between the ventilation valve 312 and control valve 320 is connected to the further ventilation line 260 between the control valve 320 and the ventilation connection 3. For this purpose, the further ventilation line 260 connects, at the further branch connection 261, to the ventilation line 230 and to the further ventilation line 240. These are thus merged in a section of a ventilation line 240 that is situated between the further branch connection 261 and the ventilation connection 3.

By means of the control valve 320, it is thus possible, in the presence of a control pressure which is discharged from the pneumatic main line 200 or from the further pneumatic line 600 via the pneumatic control line 250 from the control connection 252, for the ventilation valve 312 to be opened under the exertion of pressure by the piston 314.

In the present case, the piston 314 is designed as a double piston such that it is particularly advantageously provided that the transfer of the control valve 320 into the—in the above sense—opened state leads not only to the opening of the ventilation valve 312 but also to the unblocking of the unblockable check valve 311. In other words, the control valve 320 of the solenoid valve arrangement 300 serves for the actuation of the ventilation valve 312, which is provided separately from the check valve 311, and of the check valve 311. This leads to the air dryer arrangement 100 being pneumatically opened at both sides when the control valve 320 is transferred into the opened position. This further operating position that can be assumed by the compressed-air feed installation 1001 can, during operation, be utilized for the ventilation of the pneumatic installation 1002 and simultaneously for the regeneration of the air dryer arrangement 100.

The operating position of the compressed-air feed installation 1001 shown in FIG. 1 serves, with a flow through the check valve 311 in the pass-through direction, in particular for the filling of the pneumatic installation 1002 via the pneumatic main line 200 and the further pneumatic line 600.

The pneumatic installation 1002 of FIG. 1 in the form of an air spring installation has in this case a number of four so-called bellows 1011, 1012, 1013, 1014, which each are assigned to a wheel of a passenger motor vehicle (not illustrated in any more detail) and form an air spring of the vehicle.

Furthermore, the air spring installation has an accumulator 1015 for storing quickly available compressed air for the bellows 1011, 1012, 1013, 1014. Upstream of said bellows 1011 to 1014, in each case in a spring branch line 601, 602, 603, 604 which proceeds from a gallery 610, there is positioned in each case one solenoid valve 1111, 1112, 1113, 1114, which serves in each case as a ride-height control valve for opening or closing an air spring formed with a bellows 1011 to 1014. The solenoid valves 1111 to 1114 in the spring branch lines 601 to 604 are formed as 2/2 directional valves in a valve block 1110. In an accumulator branch line 605, a solenoid valve 1115 in the form of a further 2/2 directional valve as an accumulator valve is positioned upstream of an accumulator 1015. The solenoid valves 1011 to 1015 are connected by means of the spring and accumulator branch lines 601 to 604 and 605 to a common collecting line, specifically the gallery 610 referred to above, and then to the further pneumatic line 600. The gallery 610 is thus pneumatically connected via the pneumatic line 600 to the compressed-air connection 2 of the compressed-air feed installation 1001. In the present case, the solenoid valves 1111 to 1115 are arranged in a valve block 1010 with the five valves. The solenoid valves are shown in FIG. 1 in an electrically deenergized state—here, the solenoid valves 1111 to 1115 are in the form of solenoid valves which are closed and electrically deenergized. Other, modified embodiments that are not shown here may realize a different arrangement of the solenoid valves—it is also possible for fewer solenoid valves to be utilized in the context of the valve block 1010.

To fill the pneumatic installation 1002, the solenoid valves 1111 to 1114 positioned upstream of the bellows 1011 to 1014, and/or the solenoid valve 1115 positioned upstream of the accumulator 1015, are moved into an opened position.

Nevertheless, in the closed position of the solenoid valves 1111 to 1114 and 1115 in the pneumatic installation 1001—owing to the check valve 311 presently not being unblocked—an operating position of the pneumatic installation 1002 decoupled from the compressed-air feed installation 1001 is possible. In other words, cross-connection of bellows 1011 to 1015 (for example during off-road operation of a vehicle), filling of the bellows 1011 to 1015 from the accumulator 1015 or a pressure measurement in the pneumatic installation 1002 via the gallery 610 can be performed without the compressed-air feed installation 1001 being pressurized.

In particular, owing to the check valve 311 being blocked from the compressed-air connection 2 to the compressed-air supply 1 and owing to the control valve 320 being closed, the air dryer arrangement 100 is protected against unnecessary pressurization with compressed air.

It is thus advantageously the case that pressurization of the air dryer arrangement 100 with compressed air is not advantageous in all operating positions of the pneumatic installation 1002. Rather, for an effective and fast regeneration of the air dryer installation 100, it is advantageous for this to be performed exclusively in the event of a ventilation of the pneumatic installation 1002 from the compressed-air connection 2 to the compressed-air supply 1, with the check valve 311 unblocked.

For this purpose, as discussed above, the control valve 320 is moved into an opened switching position, such that both the ventilation valve 312 opens and the check valve 311 is unblocked. Ventilation of the pneumatic installation 1002 can take place via the first throttle 311, the unblocked check valve 311, with the air dryer arrangement 100 being regenerated, and subsequently via the second throttle 332 and the opened ventilation valve 312 for ventilation via the ventilation connection 3.

In other words, for the simultaneous unblocking actuation of the check valve 311 and opening actuation of the ventilation valve 312, a control piston 314, as a double relay piston which is pneumatically actuatable by the control valve 320, is provided, having a relay ventilation body 314.1 of the ventilation valve and a relay unblocking body 314.2 for the unblockable check valve 311. The double relay piston clarifies the present principle for the unblocking of the check valve 311 and simultaneous actuation of the ventilation valve 312 by means of the two coupled actuating elements—specifically by means of the relay unblocking body 314.2 and the relay ventilation body 314.1—which may be formed as a unipartite double relay body or, in a modification, also as separate bodies. In a particularly preferred modification of a design implementation, the abovementioned actuating elements of the double relay piston may be formed as integral regions of a double relay piston.

Figure 2:
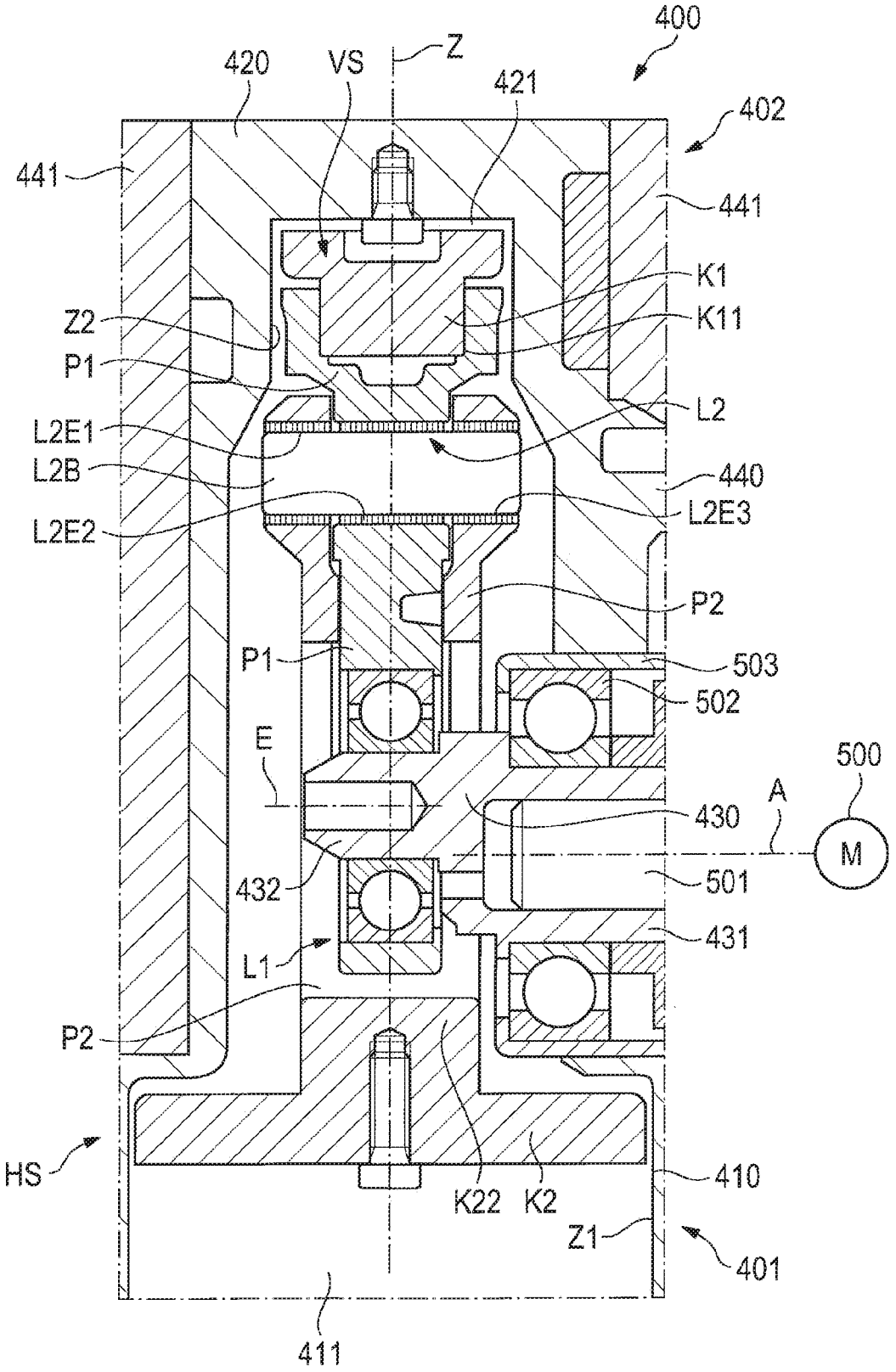
FIG. 2 shows, for an air compressor, a reciprocating-piston machine in the form of a two-stage piston compressor having a first connecting rod for a first piston of a second (high-pressure) stage and having a second connecting rod of a first (low-pressure) stage having a connecting-rod bearing and elastomer elements in the form of elastomer rings.

FIG. 2 now illustrates the details of the concept of the invention based on the example of a reciprocating-piston machine, specifically in the form of the two-stage piston compressor 400 of FIG. 1.

Referring to FIG. 2, said figure shows a reciprocating-piston machine in the form of a double compressor as per the detail D of FIG. 1, specifically a twin compressor which is designed as a two-stage piston compressor 400 and which has a first compressor stage 401 and a second compressor stage 402 and which has a motor 500 which, as drive motor M, is coupled by means of a drive shaft 501 to a crankshaft 430 of the piston compressor 400.

For this purpose, the crankshaft 430 has a drive shaft coupling 431 which serves as a receptacle for the drive shaft 501 of the drive motor M. The crankshaft 430 is, at the outside of the drive shaft coupling 431, rotatably mounted in a bearing 502 which, in the present case, is designed as a ring ball bearing. The bearing 502 is in turn held by means of a corresponding holding mechanism on the motor housing 503. In this way, the crankshaft 430, which can be driven by means of the drive motor M during operation, is formed by means of the stated drive shaft coupling 431 for the coupling of the drive shaft 501 of the drive motor 500 for the drive of the crankshaft 430.

The crankshaft 430 furthermore has an eccentric crankshaft journal 432 which is formed eccentrically with respect to the axis A on the crankshaft 430 and which extends along an eccentric axis which in this case is referred to as shaft axis E.

The eccentric crankshaft journal 432 is thus designed to drive a first connecting rod P1 directly and a second connecting rod P2 indirectly when the crankshaft 430 is driven in rotation. For this purpose, the eccentric crankshaft journal 432 is formed by means of a first connecting-rod bearing L1 for the direct mounting and direct drive of the first connecting rod P1. The second connecting rod P2 in turn is movably mounted, as a follower connecting rod, on the first connecting rod P1, which functions as a drive connecting rod P1, by means of a bearing pin L2B which is partially enclosed by an elastomer element L2 in the form of three elastomer rings L2E1, L2E2, L2E3. The first connecting-rod bearing L1 is formed as a ring ball bearing. In this exemplary embodiment, the elastomer element L2 in the form of the elastomer rings L2E1, L2E2, L2E3 encloses the bearing pin L2B completely. Alternatively, the elastomer element L2, for example in the form of elastomer ring segments L2Ea and L2Eb (cf. FIG. 6), may also enclose the bearing pin L2B only partially, for example at the top side and bottom side of the bearing pin L2B. In an exemplary embodiment (not shown), the elastomer element L2 in the form of elastomer ring segments L2Ea and L2Eb extends over approximately the upper quarter of the circumference and the lower quarter of the circumference of the bearing pin L2B, such that the lateral quarters of the bearing pin L2B are not in contact with the elastomer element L2. The elastomer element L2 permits a clearance-free mounting of the connecting rods P1 and P2. The elastomer element L2 furthermore has pronounced damping characteristics, such that the elastomer element L2 permits a noise reduction.

The first piston K1 is, by means of a piston holder K11, inserted as a separate part into the head end of the first connecting rod P1 and held there. The second piston K2 is formed integrally and in unipartite fashion on the head end K22 of the second connecting rod P2—that is to say, along a cylinder axis Z, distally opposite the first piston K1. For this purpose, the second connecting rod P2 is, as a unipartite, approximately ring-shaped component, as can be seen in FIG. 2, suspended rotatably at the elastomer element L2.

In the case of this construction, when the crankshaft 430 is driven in rotation, an eccentric rotational movement of the crankshaft journal 432 can be realized during the operation of the compressor 400, such that the first and second pistons K1, K2 are respectively moved with a reciprocating movement in order to compress compressed air in the corresponding second and first compressor stage 402, 401.

For this purpose, the second piston K2 of the first compressor stage 401 moves in a cylinder displacement chamber 411 of the first cylinder 410 in the first (low-pressure) compressor stage 401. For this purpose, the first piston K1 moves in a cylinder displacement chamber 421 of a second cylinder 420 of the second (high-pressure) compressor stage 402. The first and second cylinders 410, 420 are part of a housing 440 of the common air compressor with piston compressor 400, drive motor M and crankshaft 430. The housing 440 of the air compressor is held by means of further components 441 on the housing of a compressed-air feed installation 1001 as shown in FIG. 1.

FIG. 2 shows the twin compressor 400, in the present case in an operating position in which the second piston K2 of the (low-pressure) compressor stage 401 is in a stroke position HS, that is to say the compression of the air situated in the displacement chamber 411 is impending. By contrast, the first piston K1 of the second compressor stage 402 is situated in a compression position VS, that is to say compressed air can be discharged in compressed form from the second high-pressure stage 402 to the compressed-air feed installation 1001.

The movement of the first and second pistons K1, K2 during the operation of the piston compressor 400 takes place basically along the cylinder axis Z. The latter lies centrally symmetrically with respect to cylinder lining surfaces Z1 and Z2 of the first and second cylinder displacement chambers 411, 421 for the second and first pistons K2, K1 of the first and second cylinders 410, 420 respectively. In this regard, in FIG. 2, the connecting-rod length of the first connecting rod P1 is indicated as being 52.00 mm, as an example for the order of magnitude of the high-pressure stage 420 of the piston compressor 400.

The connecting rod of the first connecting rod P1 may for example also have a connecting-rod length between 50 and 70 mm, in particular a connecting-rod length of 66 mm. The second connecting rod may for example have a connecting-rod length between 40 and 60 mm, in particular a connecting-rod length of 53 mm. In the case of a connecting-rod length of the second connecting rod of 53 mm, the spacing between a piston head of the piston 2 and the eccentric crankshaft journal may amount to for example between 15 and 25 mm, in particular 21 mm. The abovementioned dimensions can permit a deflection angle of the connecting rods relative to one another of up to 20°, for example 14° and in particular 7°.

In this exemplary embodiment, the bearing pin L2B has a diameter of 8 mm and may have diameters between 5 mm and 12 mm. For this exemplary embodiment, the maximum rotational speed amounts to up to 2700 revolutions per minute, resulting in a maximum sliding speed of approximately 0.14 m/s, in particular 0.137 m/s. The maximum rotational speed preferably amounts to between 1500 and 3500 revolutions per minute.

The cylinder axis Z is oriented so as to run along a radius around the shaft axis E (eccentric axis E). The shaft axis E runs exactly perpendicular to the cylinder axis Z. That is to say, the eccentric crankshaft journal 432 of the crankshaft 430 is likewise arranged exactly perpendicular to the cylinder axis Z in the piston compressor 400. Sufficiently reliable and sealed running of the second and first pistons K2, K1 in the first (low-pressure) compressor stage and (high-pressure) compressor stage 401, 402 respectively is thus ensured owing to the running direction of the pistons K2, K1 likewise along the cylinder axis Z.

For this purpose, the arrangement of the first connecting rod P1 with piston K1 or of the second connecting rod P2 with piston K2 is realized such that these are mounted by means of the first connecting-rod bearing L1 and the elastomer element L2 respectively exactly along the cylinder axis Z; for example with an installation dimension of X=15.00 mm.

As a result, a reciprocating-piston machine in the form of a twin compressor 400 with first and second compressor stages 401, 402 is provided, in the case of which the first connecting rod P1 of the second, specifically (high-pressure) compressor stage 402 is formed, wherein the first connecting rod P1 is mounted by means of the connecting-rod bearing L1 directly on the crankshaft journal 432—that is to say as a drive connecting rod—and the second connecting rod P2 of the first, in this case (low-pressure) compressor stage 401 is formed, wherein the second connecting rod P2 is mounted by means of the elastomer element L2 indirectly on the crankshaft journal 432, that is to say directly on the first connecting rod P1—that is to say as a follower connecting rod on the drive connecting rod.

The above-described embodiments with drive connecting rod and follower connecting rod have duly proven to be particularly advantageous for a twin compressor. The concept of the invention is however not restricted thereto.

Figure 3A:
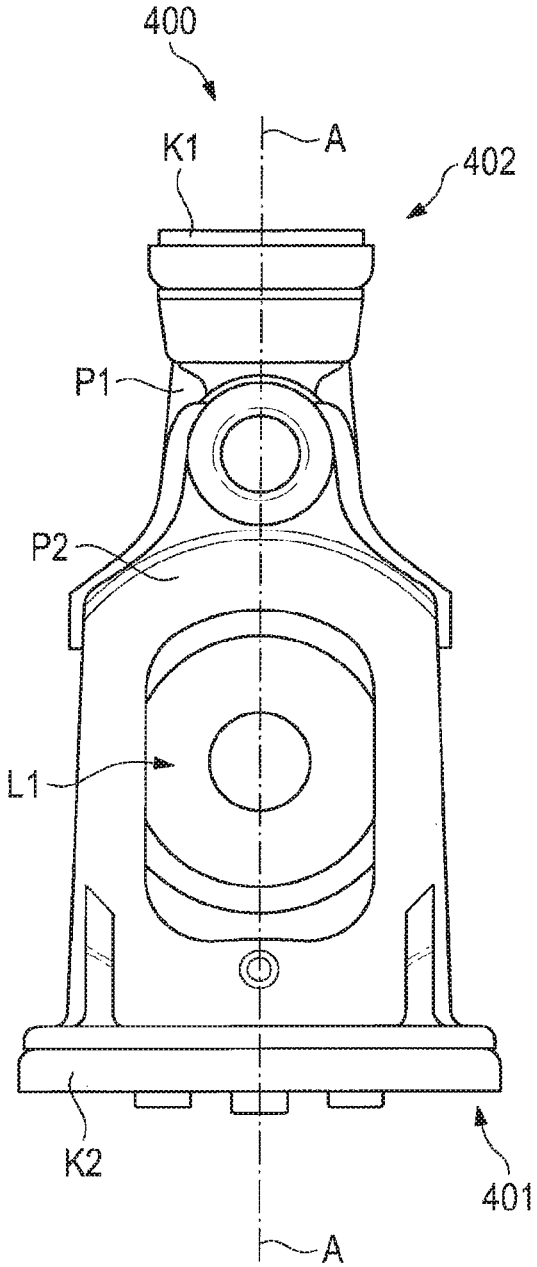
FIG. 3*a* shows, for an air compressor, a reciprocating-piston machine in the form of a two-stage piston compressor having a first connecting rod for a first piston of a second (high-pressure) stage and having a second connecting rod for a second piston of a first (low-pressure) stage, in a front view.
Figure 3B:
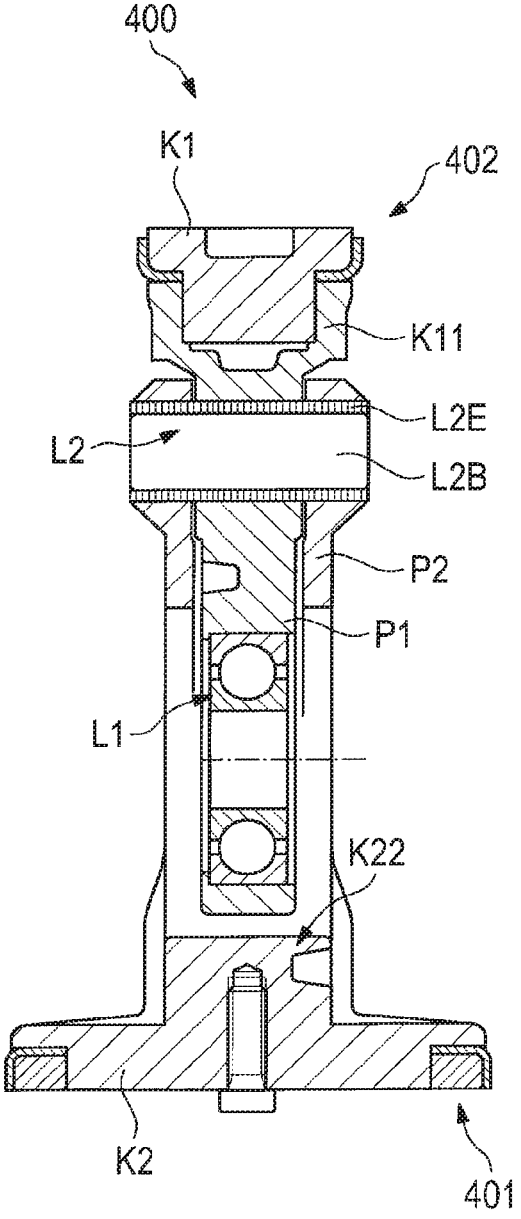
FIG. 3*b* shows, for an air compressor, a reciprocating-piston machine in the form of a two-stage piston compressor, having a first connecting rod for a first piston of a second (high-pressure) stage and having a second connecting rod for a second piston of a first (low-pressure) stage having a connecting-rod bearing and a continuous elastomer element in the form of an elastomer ring, in a sectional view along AA of FIG. 3*a;*

FIG. 3*a* shows a reciprocating-piston machine in the form of a two-stage piston compressor 400 with a first connecting rod P1 for a first piston K1 of a second (high-pressure) stage 401 and with a second connecting rod P2 for a second piston K2 of a first (low-pressure) stage 402, in a front view. FIG. 3*b* shows a sectional view along the section AA of the reciprocating-piston machine in the form of the two-stage piston compressor 400 of FIG. 3*a*. The sectional view shows that, in this exemplary embodiment, the elastomer element L2 is formed as an elastomer ring L2E extending along the entire longitudinal axis of the bearing pin L2B; this ring is therefore arranged as the only one—as per the first variant ("and") of the invention—on the bearing pin L2B. Thus, the elastomer element L2B in the form of an elastomer ring L2E is arranged between the bearing pin L2B and both connecting rod P1 and connecting rod P2, and mounts these elastically with respect to one another. Otherwise, the reciprocating-piston machine in the form of the two-stage piston compressor 400 is no different from the embodiment shown in FIG. 2.

Figure 4:
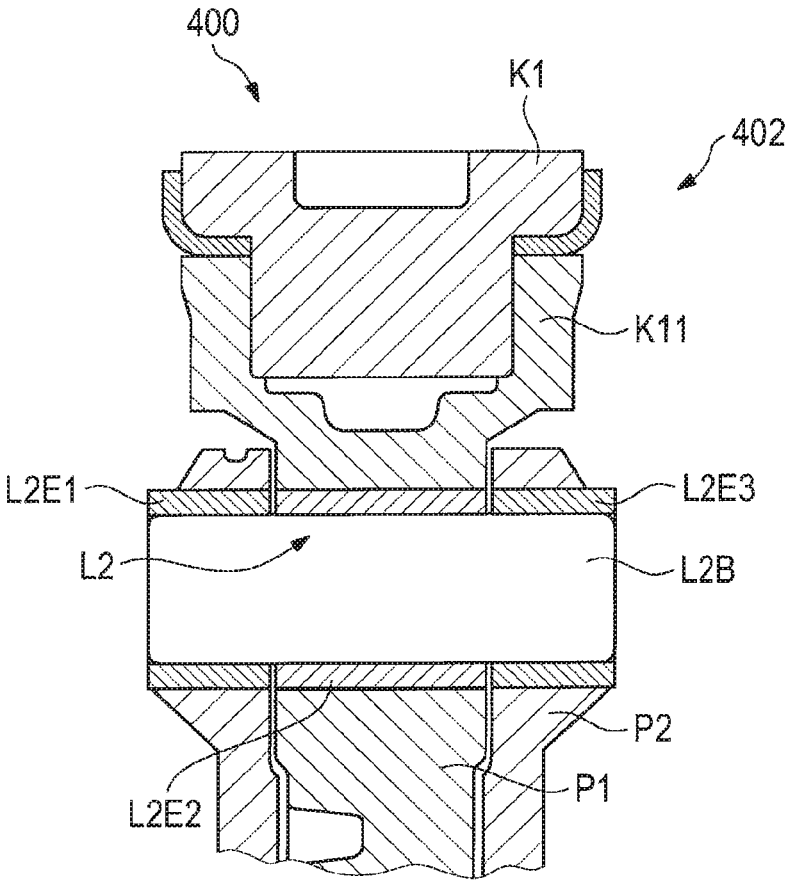
FIG. 4 shows a detail of a reciprocating-piston machine in the form of a two-stage piston compressor having a first connecting rod for a piston of a second (high pressure) stage and having a second connecting rod with elastomer elements in the form of elastomer rings.

FIG. 4 shows a detail of a reciprocating-piston machine in the form of a two-stage piston compressor 400 having a first connecting rod P1 for a piston K1 of a second (high-pressure) stage, and having a second connecting rod P2 with elastomer elements in the form of elastomer rings L2E1, L2E2, L2E3; these are thus—as per the modification of the first variant ("and") of the invention—arranged on the bearing pin L2B.

In this exemplary embodiment, the piston K1 is held by the piston holder K11, though may also, in an alternative exemplary embodiment, be formed integrally on the connecting rod P1.

The elastomer rings L2E1 and L2E3 are arranged between the bearing pin L2B and the connecting rod P2 and mount these elastically with respect to one another. The elastomer ring L2E2 is arranged between the bearing pin L2B and the connecting rod P1 and mounts these elastically with respect to one another. In this exemplary embodiment, the elastomer rings L2E1, L2E3 and L2E2 have different heights. Elastomer ring L2E2 is higher than elastomer rings L2E1 and L2E3, so that it fully covers the larger connecting rod inner side surface of connecting rod P1. In this exemplary embodiment, the connecting rod inner side surfaces of connecting rod P2 are smaller than the connecting rod inner side surface of connecting rod P1.

In an exemplary embodiment which is not shown, only connecting rod P1 is mounted by the elastomer ring L2E2, while elastomer rings L2E1 and L2E3 are not present.

Figure 5:
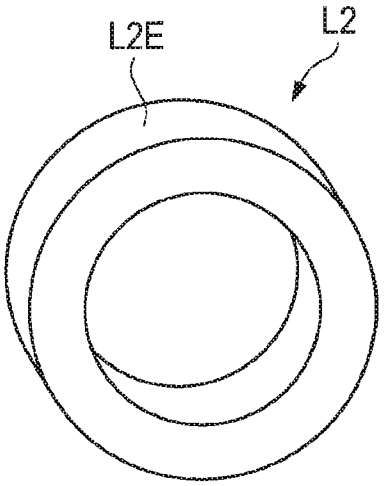
FIG. 5 shows a first exemplary embodiment of an elastomer element in the form of an elastomer ring.

Other embodiments for the connecting rods P1 and P2 are conceivable, for example instead of two and one connecting rod stems it is also possible for two and three connecting rod stems to engage in one another. In this case, further elastomer rings can be arranged for the purpose of mounting the connecting rods P1 and P2. Alternatively, it is also possible for only three of the five connecting rod inner side surfaces to be mounted. FIG. 5 shows a first exemplary embodiment of an elastomer element L2 in the form of an elastomer ring L2E. The elastomer ring L2E in this exemplary embodiment is composed of rubber or of a rubber mixture. It is alternatively also possible for some other elastic material with good damping characteristics to be used.

The height, width, length, wall thickness and the diameter of the elastomer ring L2E are freely selectable. The above-mentioned parameters are preferably adapted to the operating conditions and to the reciprocating-piston machine.

Figure 6:
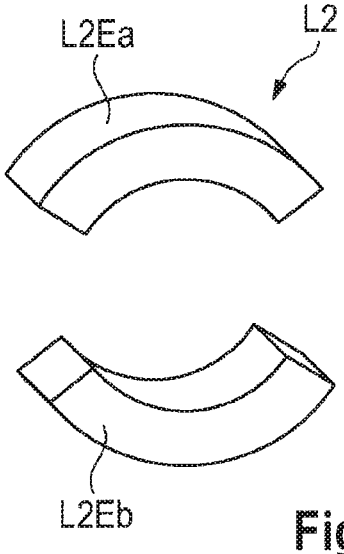
FIG. 6 shows a second exemplary embodiment of an elastomer element in the form of two elastomer ring segments.

FIG. 6 shows a second exemplary embodiment of an elastomer element L2 in the form of two elastomer ring segments L2Ea and L2Eb; these could be arranged in the same manner as the elastomer rings, labelled L2E1, L2E2, L2E3, on the bearing pin L2B of FIG. 4; thus, these could—as per a further modification of the first variant ("and") [or also of the second variant ("or") of the invention only on a single connecting rod]—be arranged as at least two elastomer ring segments L2Ea and L2Eb.

The two elastomer ring segments L2Ea and L2Eb are separated from one another and, in this exemplary embodiment, are arranged opposite one another. Alternatively, an arrangement offset with respect to one another is also possible, but this should be such that it is possible to mount a bearing pin arranged between the elastomer ring segments L2Ea and L2Eb.

In an exemplary embodiment that is not shown, it is also possible for more than two elastomer ring segments to be arranged, for example three elastomer ring segments. The three or six elastomer ring segments. For example, the center points of the elastomer ring segments can respectively be arranged offset with respect to one another by an angle on the circumference, so that they are at least partially opposite one another. In an exemplary embodiment that is not shown, six elastomer ring segments are arranged on a circumference with, in each case, an angular offset of their center points of 60°.

It is also possible for just one elastomer ring segment to be arranged, for example an elastomer ring segment extending over 270°. The elastomer ring segments can enclose a circumference from 0° to 360°.

Figure 7:
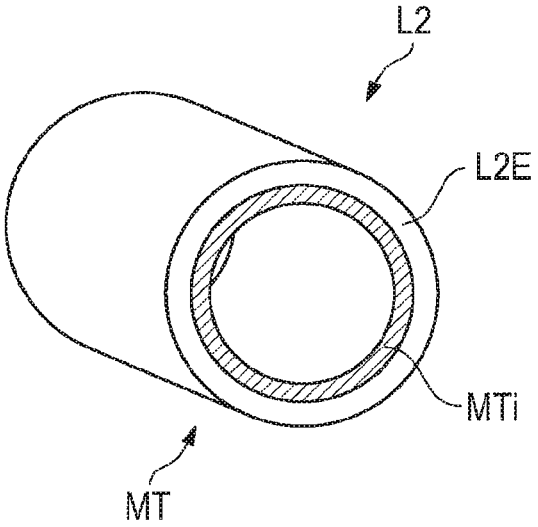
FIG. 7 shows an elastomer element in the form of an elastomer ring, which encloses a metal support in the form of a metal sleeve.

FIG. 7 shows an elastomer element L2 in the form of an elastomer ring L2E which encloses a metal support MT in the form of a metal sleeve MTi. The metal sleeve MTi is arranged in the interior of the elastomer ring L2E. In the present case, the metal sleeve MTi is pressed in. The metal sleeve MTi can also be incorporated by adhesive bonding. Alternatively, it is also possible for an elastomer layer or an elastomer coating to be injection-molded onto or vulcanized onto the metal sleeve MTi. The arrangement of an elastomer element L2 together with a metal support MT increases the stiffness of the elastomer element L2, and that of the mounting component composed of the elastomer element L2 and the metal support MT.

Figure 8A:
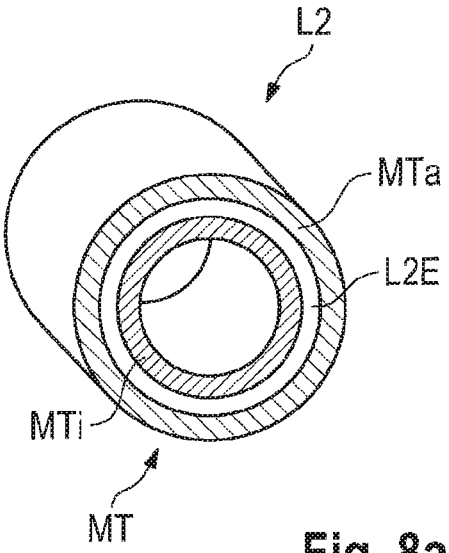
FIG. 8*a* shows an elastomer element in the form of an elastomer ring, which is arranged in a sandwich-like manner between two metal supports in the form of metal sleeves.
Figure 8B:
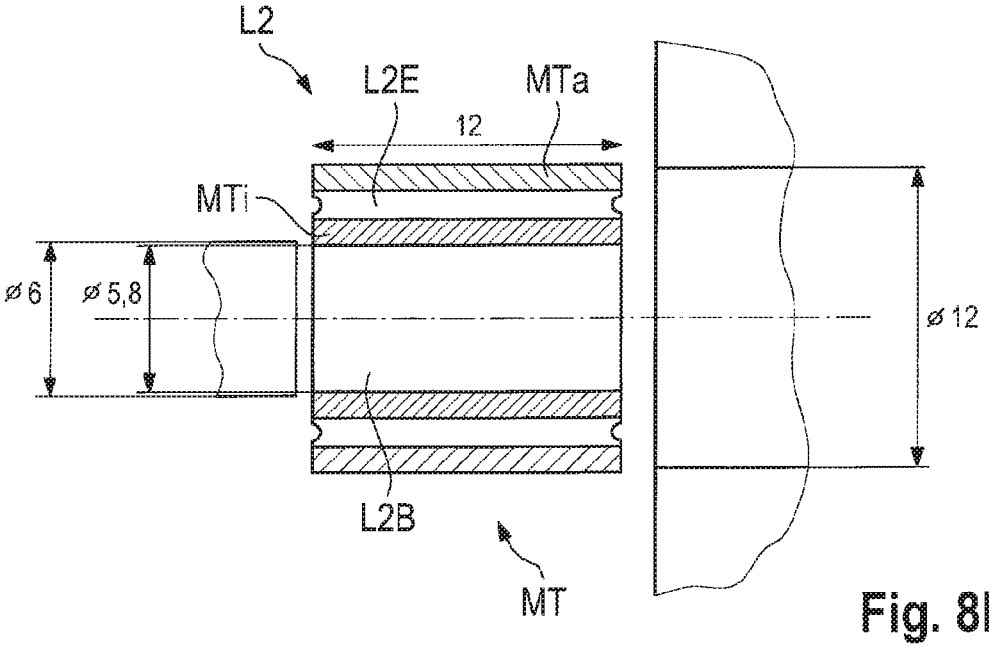
FIG. 8*b* shows a schematic illustration of an elastomer element in the form of an elastomer ring that is arranged in the manner of a sandwich between two metal supports in the form of metal sleeves.

FIG. 8*a* shows an elastomer element L2 in the form of an elastomer ring L2E that is arranged in the manner of a sandwich between two metal supports MT in the form of metal sleeves MTi and MTa. FIG. 8*b* shows a schematic illustration of the mounting component composed of the elastomer element L2 and the metal sleeves MTi and MTa, shown in FIG. 8*a*.

Alternatively, it is also possible for an elastomer layer to be injection-molded between the metal sleeves MTi and MTa.

The arrangement between two metal sleeves further increases the stiffness of the assembled mounting component.

Figure 9:
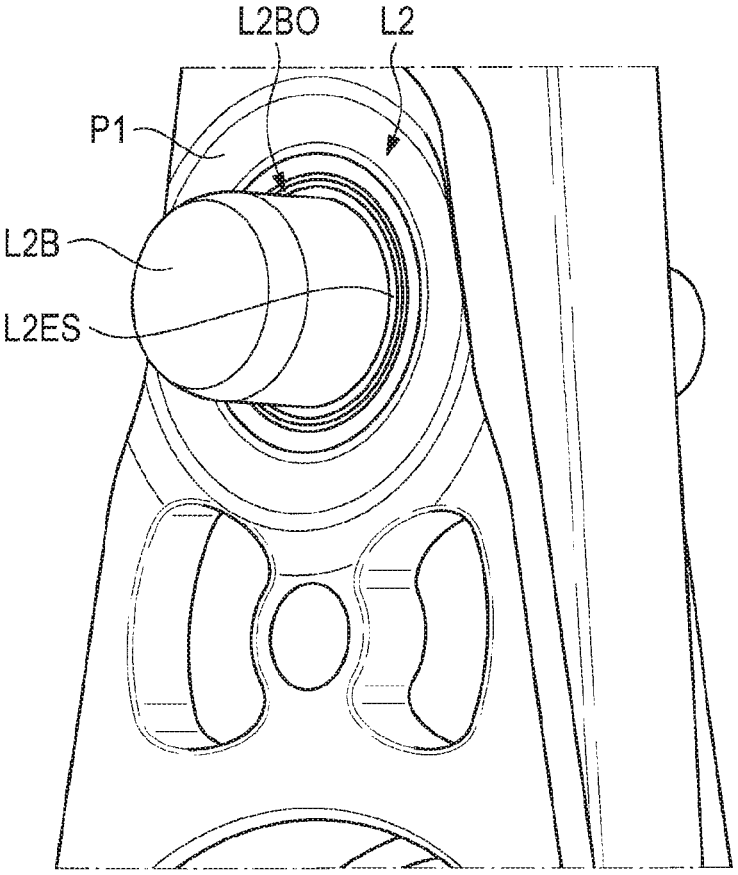
FIG. 9 shows a third exemplary embodiment of an elastomer element in the form of an elastomer coating injection-molded onto a bearing pin surface.

FIG. 9 shows a third exemplary embodiment of an elastomer element L2 in the form of an elastomer layer L2ES, or an elastomer coating, injection-molded onto a part of the bearing pin surface L2BO. The elastomer layer L2ES can also be vulcanized on. Alternatively, the elastomer layer L2ES can also be injection-molded between the connecting rod inner surface of connecting rod P1 and the bearing pin surface L2BO, so that it connects the connecting rod P1 and the bearing pin L2B fixedly and directly. The elastomer layer L2ES is in this FIG. 9—that is to say preferably as per the second variant ("or") of the invention only on a single connecting rod, namely the first connecting rod P1—arranged as at least one annular layer.

Figure 10:
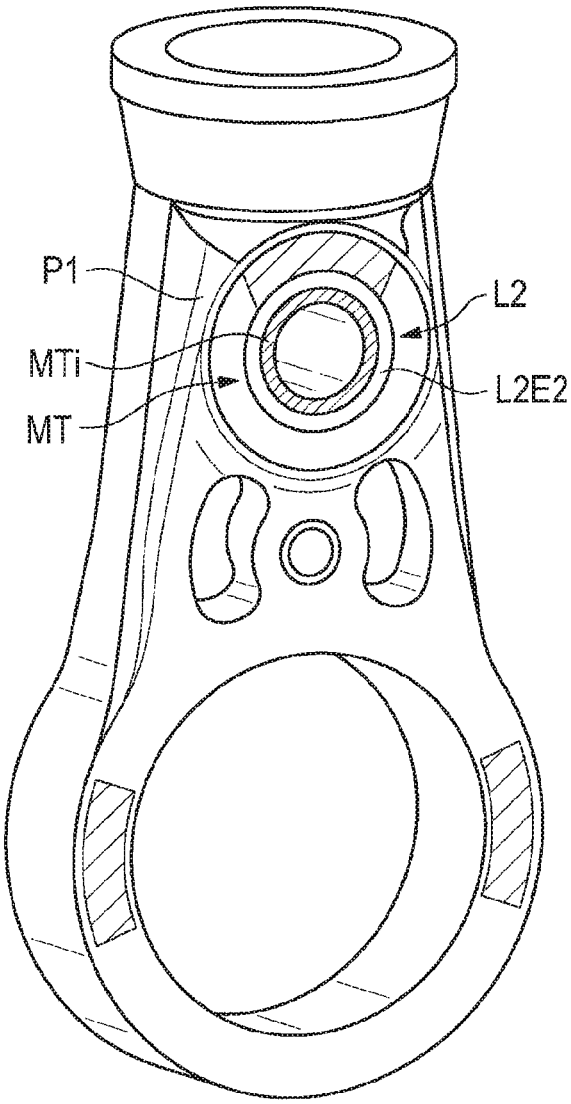
FIG. 10 shows a first connecting rod with, arranged therein, an elastomer element in the form of an elastomer ring which encloses a metal support in the form of a metal sleeve.

FIG. 10 shows a first connecting rod P1 having, arranged therein, an elastomer element L2 in the form of an elastomer ring L2E2 which encloses a metal support MT in the form of a metal sleeve MTi. The connecting rod P1 can, by means of the mounting component composed of the elastomer ring L2E2 and the metal sleeve MTi, be mounted on a bearing pin L2B (not shown). The mounting component is arranged in this FIG. 10—that is to say preferably as per the second variant ("or") of the invention only on a single connecting rod, namely the first connecting rod P1.

In FIG. 9 and FIG. 10, it is equally possible for the elastomer layer L2ES or the elastomer element L2 to be arranged on the second connecting rod P2 (not shown in FIG. 9, FIG. 10), as per the first variant.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE DESIGNATIONS

0 Air supply, intake
0.1 Filter element, air filter
1 Compressed-air supply
2 Compressed-air connection
3 Ventilation connection
3.1 Ventilation filter, filter element, silencer
100 Air dryer arrangement
101 Drying container
200 Pneumatic main line
201 First part of the pneumatic main line
202 Second part of the pneumatic main line
230 Branch line, ventilation line
240 Further ventilation line
241 Further branch connection
242 Port section
250 Pneumatic control line
251 Line section
252 Control connection
260 Further ventilation line
261 Branch connection
270 Air supply line
300 Valve arrangement, solenoid-type valve arrangement
310 Directional valve arrangement
311 Check valve
312 Ventilation valve
313 Pressure-limiting means
314 Piston
314.1 Relay ventilation body
314.2 Relay unblocking body
315 Adjustable spring
320 Control valve
321 Electrical control line
322 Coil
331 First throttle
332 Second throttle
400 Air compressor in the form of a two-stage piston compressor
401 First (low-pressure) compressor stage
402 Second (high-pressure) compressor stage
410 First cylinder
411,421 Cylinder displacement chamber
420 Second cylinder
430 Crankshaft
431 Drive shaft coupling
432 Crankshaft journal
440 Housing
441 Further housing components
500 Motor
501 Drive shaft
M Drive motor
502 Bearing
600 Further pneumatic line
601, 602, 603, 604 Spring branch line
605 Accumulator branch line
610 Gallery
1000 Compressed-air feed system
1001 Compressed-air feed installation
1002 Pneumatic installation
1011, 1012, 1013, 1014 Bellows
1110 Valve block
1015 Accumulator
1111 to 1114 Solenoid-type accumulator directional valve
1115 Solenoid-type directional valve
A Axis
D Detail
DL Compressed-air flow
E Eccentric axis, shaft axis
HS Stroke position
K1, K2 Piston
K11 Piston holder
K22 Head end
L1 Connecting-rod bearing, ring ball bearing, joint plain bearing
L2 Elastomer element
L2B Bearing pin
L2E1, L2E2, L2E3, L2E Elastomer rings
L2Ea, L2Eb Elastomer ring segments
L2ES Elastomer layer
MT Metal support
MTi, MTa Metal sleeve; internal, external
P1, P2 First, second connecting rod
VS Compression position
Z Cylinder axis
Z1, Z2 Cylinder running surface

The invention claimed is:

1. A reciprocating-piston machine comprising:

a first cylinder and a first piston assigned to the first cylinder and a second piston assigned to the first cylinder or a second cylinder, wherein the first piston and the second piston are configured, during operation, to be deflected in a respective cylinder displacement chamber;

a crankshaft configured, during operation, to be driven, the crankshaft having an eccentric crankshaft journal and a drive shaft coupling configured for coupling a drive shaft of a drive motor for driving the crankshaft;

a first connecting rod configured to deflect the first piston and configured to be moved by the eccentric crankshaft journal;

a second connecting rod configured to deflect the second piston configured to be moved by a bearing pin about which the first connecting rod and the second connecting rod are rotationally movable; and at least one of:

a first elastomer element arranged between the bearing pin and the first connecting rod, the first elastomer element mounting the bearing pin and the first connecting rod elastically with respect to one another, and a second elastomer element arranged between the bearing pin and the second connecting rod, the second elastomer element mounting the bearing pin and the second connecting rod elastically with respect to one another.

2. The reciprocating-piston machine as claimed in claim 1, wherein the eccentric crankshaft journal and/or the drive shaft coupling are/is aligned parallel to a shaft axis running perpendicular to a cylinder axis.

3. The reciprocating-piston machine as claimed in claim 1, wherein at least one of the first and second connecting rods is mounted by at least one connecting-rod bearing directly or indirectly on the crankshaft journal, and/or at least one of the first and second pistons is integrally formed on, fixedly connected to, or held by a piston holder on the or on at least one connecting rod.

4. The reciprocating-piston machine as claimed in claim 1, wherein the first connecting rod is configured to be moved directly by the eccentric crankshaft journal and the second connecting rod is configured to be moved indirectly by the eccentric crankshaft journal.

5. The reciprocating-piston machine as claimed in claim 1, wherein at least one of the first elastomer element and the second elastomer element is a rubber element or is introduced as a rubber coating between the bearing pin and connecting rod.

6. The reciprocating-piston machine as claimed in claim 1, wherein at least one of the first elastomer element and the second elastomer element is a separate part, in particular inserted or clamped between the bearing pin and the connecting rod, and/or wherein at least one of the first elastomer element and the second elastomer element serves for mounting rotational movements of the connecting rods about the bearing pin and for generating a dampening action.

7. The reciprocating-piston machine as claimed in claim 1, wherein at least one of the first elastomer element and the second elastomer element is an applied layer to a connecting-rod inner surface of the first connecting rod and/or to a connecting-rod inner surface of the second connecting rod, and/or wherein at least one of the first elastomer element and the second elastomer element serves for mounting rotational movements of the connecting rods about the bearing pin and for producing damping.

8. The reciprocating-piston machine as claimed in claim 1, wherein at least one of the first elastomer element and the second elastomer element is of ring-shaped, bushing-shaped, or sleeve-shaped form.

9. The reciprocating-piston machine as claimed in claim 1, wherein at least one of the first elastomer element and the second elastomer element is plate-shaped.

10. The reciprocating-piston machine as claimed in claim 1, wherein at least one of the first elastomer element and the second elastomer element is connected to or in contact with a metal support, a metal sleeve, a metal ring, or a plurality of metal plates.

11. The reciprocating-piston machine as claimed in claim 1, wherein at least one of the first elastomer element and the second elastomer element has at least two elastomer rings which are arranged parallel and with a spacing to one another around the bearing pin.

12. The reciprocating-piston machine as claimed in claim 1, wherein at least one of the first elastomer element and the second elastomer element has at least one elastomer plate arranged only at one side or at least two mutually oppositely situated elastomer plates arranged at a bearing pin top side and at a bearing pin bottom side.

13. The reciprocating-piston machine as claimed in claim 1, wherein at least one of the first elastomer element and the second elastomer element is arranged between an inner and an outer metal support, and wherein the inner metal support is connected to the bearing pin and the outer metal support is connected to at least one of the connecting rods.

14. The reciprocating-piston machine as claimed in claim 1, wherein at least one of the first elastomer element and the second elastomer element is arranged between an inner metal support and at least one of the connecting rods, and the inner metal support is connected to the bearing pin and at least one of the first elastomer element and the second elastomer element is connected to at least one of the connecting rods.

15. The reciprocating-piston machine as claimed in claim 1, wherein at least one of the first elastomer element and the second elastomer element is arranged between the bearing pin and an outer metal support, and is connected to the bearing pin, and wherein the outer metal support is connected to at least one of the connecting rods.

16. The reciprocating-piston machine as claimed in claim 1, wherein at least one of the first elastomer element and the second elastomer element has at least two mutually separate ring segments.

17. The reciprocating-piston machine as claimed in claim 16, wherein of the at least two separate ring segments, at least a first ring segment is arranged on a bearing pin top side between the bearing pin and the connecting rod and at least a second ring segment arranged on a bearing pin bottom side between the bearing pin and the connecting rod.

18. The reciprocating-piston machine as claimed in claim 16, wherein the mutually separate ring segments of the elastomer element enclose at most one-quarter of a circumference on the bearing pin top side and at most one-quarter of a circumference on the bearing pin bottom side, so that at least half of the circumference of the bearing pin top side of the bearing pin is free of the elastomer element.

19. The reciprocating-piston machine as claimed in claim 1, wherein a maximum deflection angle of the deflection of the connecting rods between respective longitudinal axes of the connecting rods amounts to at most 14°.

20. The reciprocating-piston machine as claimed in claim 1, wherein:

the first connecting rod is mounted by a connecting-rod bearing directly on the crankshaft journal, and the first piston is held on the first connecting rod by a piston holder, and the second piston is formed integrally on the second connecting rod.

21. The reciprocating-piston machine as claimed in claim 1, wherein:

the piston compressor a two-stage or multi-stage compressor with at least a first and second compressor stage or is designed as a twin-cylinder or multi-cylinder compressor, the first connecting rod of the second compressor stage is formed, the first connecting rod is mounted by a connecting-rod bearing directly on the crankshaft journal, and/or the second connecting rod of the first is formed.

22. A compressed-air feed installation for operating a pneumatic installation of a vehicle with a compressed-air flow, the compressed-air feed installation comprising:

an air dryer arrangement in a pneumatic main line which pneumatically connects a compressed-air supply from an air compressor and a compressed-air connection to the pneumatic installation;

a valve arrangement which is pneumatically connected to the pneumatic main line and which serves for controlling the compressed-air flow; and an air dryer in the pneumatic main line, wherein an air compressor with a reciprocating-piston machine as claimed in claim 1 is connected to the compressed-air supply.

23. A compressed-air feed system having a pneumatic installation and a compressed-air feed installation according to claim 22 for operating the pneumatic installation with a compressed-air flow, wherein the pneumatic main line pneumatically connects a compressed-air supply from an air compressor with the reciprocating-piston machine as claimed in claim 1 and a compressed-air connection to the pneumatic installation.

24. A vehicle having a pneumatic installation and having a compressed-air feed installation as claimed in claim 22 for operating the pneumatic installation with a compressed-air flow.

* * * * *